United States Patent [19]

Cook et al.

[11] Patent Number: 4,989,564

[45] Date of Patent: Feb. 5, 1991

[54] IDLE AIR BYPASS

[75] Inventors: John E. Cook; Ronald F. Mitchell, both of Chatham, Canada

[73] Assignee: Siemens-Bendix Automotive Electronics Limited, Chatham, Canada

[21] Appl. No.: 463,093

[22] Filed: Jan. 10, 1990

[51] Int. Cl.[5] ..... F02M 3/00

[52] U.S. Cl. ..... 123/339; 251/30.03

[58] Field of Search ..... 123/339, 585; 251/30.03, 30.04, 335.2, 38; 137/907

[56] References Cited

U.S. PATENT DOCUMENTS

| | | | |
|---|---|---|---|
| 4,738,237 | 4/1988 | Brandner et al. | 123/339 |
| 4,750,461 | 6/1988 | Hasebe et al. | 123/339 |
| 4,823,750 | 4/1989 | Niida et al. | 251/30.03 |
| 4,829,960 | 5/1989 | Yuzawa et al. | 123/339 |
| 4,870,944 | 10/1989 | Matsumoto et al. | 123/585 |
| 4,873,955 | 10/1989 | McAuliffe, Jr. | 123/339 |
| 4,913,111 | 4/1990 | Kalippke et al. | 251/335.2 |

FOREIGN PATENT DOCUMENTS

| | | | |
|---|---|---|---|
| 3802262 | 8/1989 | Fed. Rep. of Germany | 123/339 |
| 0029033 | 2/1988 | Japan | 123/239 |

*Primary Examiner*—Raymond A. Nelli

*Attorney, Agent, or Firm*—George L. Boller; Russel C. Wells

[57] ABSTRACT

A valve assembly of novel configuration is associated with the main air induction passage of a fuel-injected, spark-ignited, automotive internal combustion engine for the purpose of regulating the idle air flow. The valve assembly has an inlet connected upstream of the throttle. A pintle controls the restriction that the valve assembly imposes on the idle air flow. The valve assembly is controlled by the engine computer selectively energizing a solenoid on the assembly. The solenoid armature controls flow through another flow path of the valve assembly that parallels the idle air flow path. A movable internal wall divides the valve assembly's body into two variable volume chambers. One chamber forms part of the idle air bypass while the other forms part of the parallel flow path. The one chamber is essentially at manifold vacuum while the other is regulated by a bleed valve and two orifices in the parallel flow path. Positioning of the movable wall positions the pintle.

27 Claims, 1 Drawing Sheet

IDLE AIR BYPASS

BACKGROUND AND SUMMARY OF THE INVENTION

This invention relates to an idle air bypass valve for a fuel injected internal combustion engine.

Such a valve is used in an automotive vehicle to control the flow of combustion air into the engine when the engine is idling. Because the load on the engine may vary for any of a number of different reasons while the engine is idling, the idle air bypass valve is required so that the proper amount of combustion air is inducted for all idle conditions. For example, a typical idle air bypass valve placed under the control of the engine control computer may strive to maintain a stable idle speed for the engine irrespective of the load imposed on the engine or of the engine temperature. For example, if the idle load on the engine changes so that there is a resulting change in manifold vacuum, the idle air bypass valve should respond by making a corresponding change in the degree of restriction that it imposes on the idle air flow such that proper air flow for the desired idle operation is maintained.

Heretofore, certain engine idle control strategies have involved anticipatory adjustment of the idle air bypass valve prior to allowing changes in accessory loadings of the engine (i.e., air conditioning load, power steering load, etc.). One object of the present invention is to provide an idle air bypass valve which exhibits a sufficiently fast response that it becomes possible to eliminate such anticipatory adjustments.

Certain known solenoid-actuated idle air bypass valves are mechanically biased to be normally closed and therefore require a certain degree of electrical energization before opening. If the electrical energization is not received by the solenoid, or the solenoid actuator itself fails, opening of the idle air bypass is impossible, and typically the engine cannot be started. Another object of the present invention is to provide an idle air bypass valve which is open at engine starting without the need for electrical power to the valve. A related feature is that in the event of electrical failure of the solenoid-actuator or of the control circuitry to the solenoid, the idle air bypass valve of the invention still permits the passage of some air into the engine so that it is possible that the engine may remain running and therefore be driven to a service facility.

The foregoing, along with additional features and benefits of the invention, will be seen in the ensuing detailed description that is accompanied by a drawing. The drawing discloses an exemplary presently preferred embodiment of the invention according to the best mode contemplated at the present time in carrying out the invention.

DESCRIPTION OF THE PREFERRED EMBODIMENT

Figure 1:
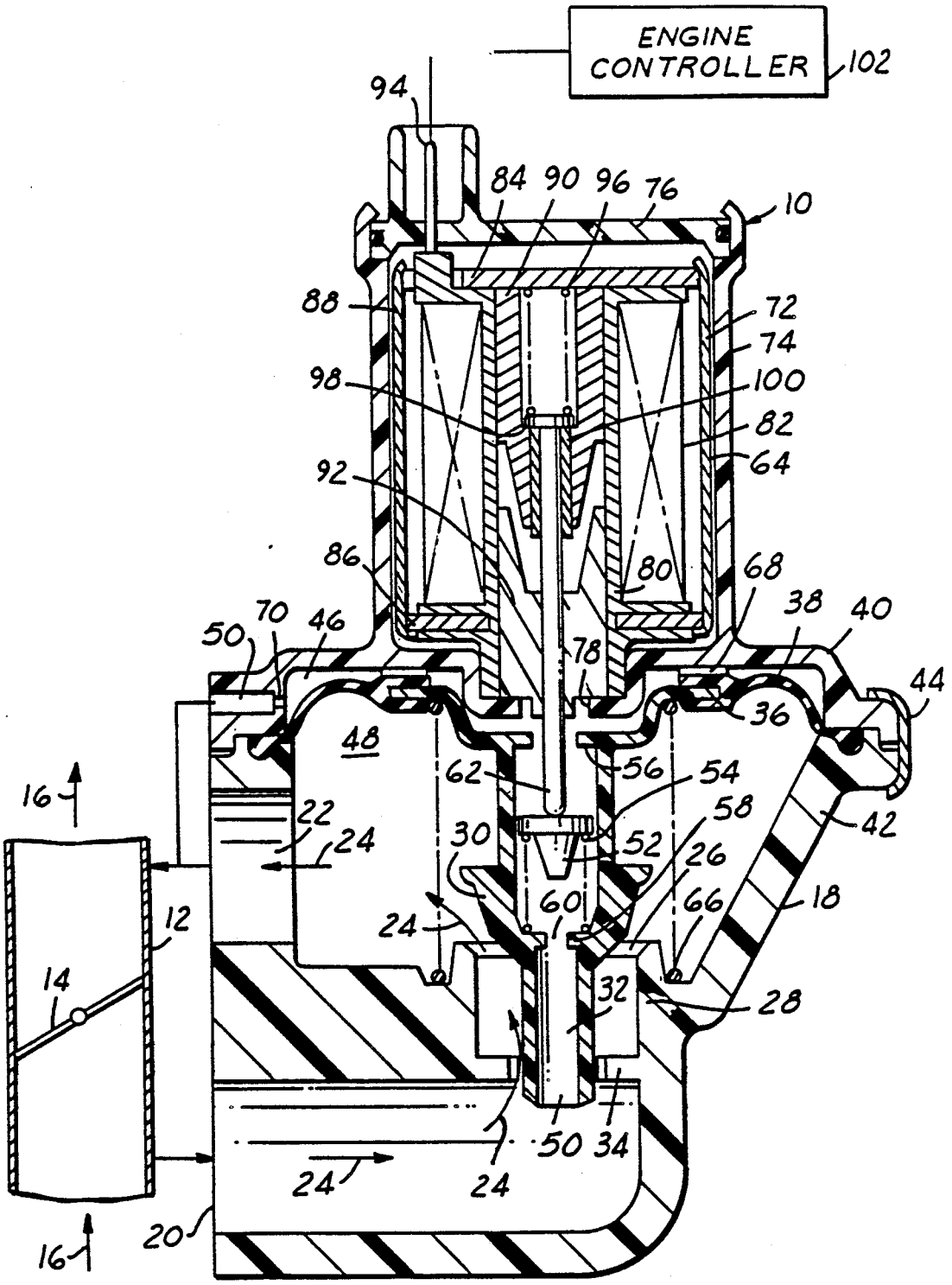
FIG. 1 is a longitudinal cross-sectional view through an idle air bypass valve assembly embodying the invention and shows the assembly in association with the main induction passage of a fuel injected engine and the engine electronic controller.

The drawing shows an idle air bypass valve assembly 10 in association with that portion of the main air induction passage 12 of a fuel-injected, spark-ignited automotive internal combustion engine which contains a throttle mechanism 14 shown in closed position. The arrows 16 represent the direction of combustion air flow into the engine when throttle mechanism 14 is opened to accelerate the engine from idle.

Valve assembly 10 comprises a body 18 having an inlet 20 and an outlet 22. Inlet 20 is placed in fluid communication with induction passage 12 at a point upstream of throttle mechanism 14 while outlet 22 is placed in fluid communication with induction passage 12 at a point downstream of the throttle mechanism. The arrows 24 denote the idle air bypass flow through body 18 between inlet 20 and outlet 22.

The path of idle air bypass through body 18 contains a frustoconical valve seat 26 at the rim of a circular boss 28 that is fashioned integrally with and internally of body 18. A generally tubular cylindrical-shaped valve pintle 30 is disposed in the path of idle air bypass through body 18 coaxially with valve seat 26 and is arranged for longitudinal positioning along the coaxis. The drawing shows pintle 30 fully unseated from valve seat 26, thereby rendering the idle air bypass fully open. Increasing the displacement of pintle 30 toward valve seat 26 from the FIG. 1 position will increasingly restrict the bypass until such time as full seating occurs thereby closing the bypass to flow. The pintle is shaped in such a manner that a desired relationship between restriction and pintle position is obtained. Pintle 30 further includes a depending stem 32 that aids in maintaining coaxiality of the pintle with valve seat 26. For all positions of the pintle, stem 32 is guided by a ring 34 fashioned integrally with and internally of body 18. The ring's opening is constructed in a toothed manner so that air can flow freely through the ring when the pintle is unseated from the valve seat.

Pintle 30 still further includes a flange 36 at the end thereof that is opposite stem 32. The outer margin of flange 36 is joined in a sealed manner with the inner margin of a flexible annular diaphragm 38. The outer margin of diaphragm 38 is held in a sealed manner interiorly of body 18. More specifically, body 18 comprises multiple parts assembled together, with the entire outer margin of the diaphragm being captured between mating portions of parts 40 and 42, and the latter two parts being held in assembly by a crimp ring 44.

Body 18 is shaped such that in cooperation with flange 36 and diaphragm 38, two variable volume chambers 46 and 48 are formed interiorly of body 18. Flange 36 and diaphragm 38 form a movable wall that is positionable generally in the axial direction to axially position pintle 30 with respect to valve seat 26. The positioning of this movable wall is controlled by the respective volumes of the two variable volume chambers 46, 48.

Chamber 48 forms a portion of the idle air passage; chamber 46, a portion of a flow path 50 that, at least in part, parallels the idle air passage. In the illustrated valve assembly, this flow path 50 that parallels the idle air passage begins at the distal end of stem 32 and extends completely through pintle 30. From there, it continues as chamber 46 and finally exits chamber 46 as a radial passage that is placed in fluid communication with induction passage 12 in the same manner as is outlet 22.

That portion of flow path 50 which extends through pintle 30 contains a valve element 52, a helical coil spring 54, and a valve seat 56. An internal shoulder 58 of the pintle within flow path 50 forms both a seat for one end of spring 54 and an orifice 60 for flow path 50. The opposite end of spring 54 bears against a shoulder of valve element 52 to urge the valve element into contact with the semi-spherical distal end of a pin 62 that is a part of an actuating means 64 that will be described in detail later on. The drawing illustrates valve element 52 unseated from seat 56 so that the area circumscribed by seat 56 is open to flow. The O.D. of the valve element is sized in relation to the passageway through the pintle such that air can flow freely past the valve element when it is unseated from valve seat 56; however, when the valve element is seated on the valve seat, flow into chamber 46 from the inlet of flow path 50 is not allowed. The valve seat 56 is a separate circular annular part whose outer edge is joined in a sealed manner to the pintle after valve element 52 and spring 54 have been assembled into the pintle. The I.D. across valve seat 56 is sufficiently large in relation to the diameter of the portion of pin 62 passing therethrough that they impose no significant flow restriction in comparison to that of orifice 60 for all but the least unseated positions of valve element 52 from valve seat 56, such as that of FIG. 1.

A helical coil spring 66 is disposed within chamber 48 and functions to bias pintle 30 away from valve seat 26 such that the movable wall that is formed by flange 36 and diaphragm 38 is urged into abutment against the interior of part 40. In such condition, chamber 48 has maximum volume and chamber 46, minimum volume. Stops 68 that provide the abutment stop between the movable wall and part 40 are circumferentially spaced so that communication between radially inner and outer portions of chamber 46 is not lost when the volume of chamber 46 is at its minimum. A second orifice 70 is provided in flow path 50 and is located at the exit of the flow path from chamber 46.

The relative sizes of the orifices 60 and 70 are important in controlling the flows into and out of chamber 46. Specifically, when flow through flow path 50 is permitted, orifice 60 permits chamber 46 to be filled at a faster rate than the chamber can be exhausted through orifice 70. The effect is to urge chamber 46 toward maximum volume.

The description of actuating means 64 will now be given. The pin 62 is a part of a solenoid assembly 72 that is disposed within a cylindrical walled portion 74 that is integrally formed with part 40. After assembly of the solenoid assembly into body 18 through the open end of walled portion 74, said open end is closed in a sealed manner by a circular end closure 76 and such that the solenoid assembly is constrained against axial displacement within walled portion 74. Part 40 has a suitable hole 78 through which pin 62 passes before passing through the hole of valve seat 56.

Solenoid assembly 72 further comprises a bobbin 80 containing a wound electromagnetic coil 82 between its end flanges. There are metal pole pieces 84 and 86 at the bobbin's ends, and the exterior of the bobbin is within a metal shell 88 that extends between said pole pieces. Adjoining pole piece 84 and extending part way into the circular central bore of the bobbin is a stator 90. A part 92, together with pin 62, form an armature that is positionable along a portion of the bobbin's central circular bore in accordance with the degree of magnetic force that is exerted by the solenoid assembly when energized by electric current that is delivered via terminals 94 to coil 82. Pin 62 and part 92 are joined in any suitable manner for motion in unison, but it is desirable for the pin to be of a non-magnetic material so that it does not promote stray flux that might otherwise impair the solenoid's efficiency. Before the end of the assembly is closed by pole piece 84, pin 62 is passed, shank end first, through the bore of stator 90, and a helical coil spring 96 is disposed between the pin's head and pole piece 84 for the purpose of tending to urge the pin's head against a shoulder within the stator bore. A sleeve 100 is fitted into the bore of the stator below shoulder 98 to aid armature alignment.

As increasing electric current is delivered to coil 82, the armature is increasingly retracted into the bobbin so that the axial positioning of the armature is a function of the energy input to the solenoid. The energy input to the solenoid is under the control of an electronic engine controller 102, and the solenoid may be energized with either a controlled D.C. or pulse width modulated input.

Valve 10 operates in the following manner. Inlet 20 and the entrance end of flow path 50 are communicated to filtered air that is essentially at atmospheric pressure. Outlet 22 and the exit end of flow path 50 are communicated to the engine manifold. The drawing depicts the condition of no manifold vacuum and no electrical energy input to the solenoid from engine controller 102. The idle air bypass is therefore fully open to flow.

The idle air bypass is sized such that upon starting and idle running of the engine, chamber 48 is placed at or near manifold vacuum. Chamber 46 on the other hand remains communicated essentially to atmospheric pressure. Consequently, upon starting and idling of the engine (throttle mechanism 14 remaining closed), the pressure differential created across the movable wall formed by diaphragm 38 and pintle flange 36, in conjunction with the force of spring 66 acting on the movable wall, are such as to cause the pintle to move toward closure of the bypass so long as there continues to be no electrical energy input to solenoid coil 82. The motion of the pintle toward valve seat 26 will however be accompanied by a corresponding relative motion of valve element 52 toward valve seat 56 due to the effect of spring 54. In the position depicted by FIG. 1, the amount of pintle travel that is required to seat the pintle on valve seat 26 exceeds that at which valve element 52 seats on valve seat 56. In other words, valve element 52 will close flow path 50 before pintle 30 can close the idle air bypass.

The closure of flow path 50 immediately stops the communication of chamber 46 to atmosphere with the result that vacuum begins to be immediately drawn in the chamber by virtue of the communication of the chamber to the engine intake manifold via orifice 70. Whereas chamber 46 had been increasing in volume and chamber 48 decreasing in volume while chamber 46 was communicated to atmosphere, this now reverses causing the pintle to move away from valve seat 26. A small amount of such motion however will re-unseat valve element 52 from seat 56 with the result that flow path 50 is re-opened to atmosphere through orifice 60. Since the latter is less restrictive than orifice 70, the vacuum in chamber 46 immediately commences to diminish as the pressure in the chamber moves toward atmospheric.

The nature of the valve action is therefore seen to be a regulatory one whereby the pintle is regulated in an essentially stable manner to cause a certain degree of opening of the bypass that allows a suitable amount of idle air flow for a corresponding level of manifold vacuum so that the engine can continue to idle, even if the solenoid is never energized. It can therefore now be appreciated that the idle air bypass valve of the present invention can avoid the loss of idle air flow into the engine in the event of a condition corresponding to the loss of electrical power to the valve solenoid, such a condition occurring either because of a failure of the solenoid or of the control circuitry from engine controller 102.

The electrical energization of solenoid assembly 72 will produce a re-positioning of pin 62 from the position of FIG. 1 against the force exerted by spring 96 as it is being compressed. The amount of re-positioning is correlated with the degree to which the solenoid assembly is electrically energized. In other words, the greater the degree of energization, the more that pin 62 is retracted into the solenoid assembly The effect of any particular amount of pin retraction is to cause a corresponding stable re-positioning of pintle 30, and hence a corresponding adjustment in the degree of restriction that is imposed on the idle air flow by the idle air bypass valve. Engine controller 102 operates on an idle control strategy that is determined by the engine manufacturer and results in operation of the idle air bypass valve appropriate to that strategy.

The valve assembly is able to compensate for rapid changes in intake manifold vacuum. If there is an increase or decrease in manifold vacuum at engine idle due to a change in engine load, the valve can react to decrease or increase the air flow as required. Such an automatic compensation feature can keep engine idle speed stable and offers the potential for eliminating the need for anticipatory adjustment of the valve assembly before load changes are allowed to occur.

Detailed design of any specific valve assembly embodying principles of the invention is executed using conventional design and engineering procedures. Several of the parts, such as body 18, cap 76, and pintle 30 for example, can be fabricated from suitable plastics. While a presently preferred embodiment of the invention has been illustrated and described, it should be appreciated that principles are applicable to other embodiments.

What is claimed is:

1. In an internal combustion engine having a main induction air passage through which combustion air is inducted when the engine is operating at non-idle, an electronic control system that exercises control over certain functions associated with engine operation, and an idle air bypass valve assembly comprising an idle air passage bypassing that portion of the main induction air passage which contains a throttling mechanism for the main induction air passage, an idle air control valve for selectively controlling idle air flow through said idle air passage, a mechanism for operating said idle air control valve comprising a transducer having an armature means that is selectively positionable along a path of travel in accordance with the value of a control signal issued by the electronic control system, the improvement in said idle air bypass valve assembly which comprises a movable wall that separates two variable volume chambers from each other and that is selectively positionable in accordance with the respective volumes of said variable volume chambers to select the degree of restriction imposed by said idle air control valve on flow through said idle air passage, one of said variable volume chambers forming a portion of said idle air passage and the other of said variable volume chambers forming a portion of a flow path that parallels said idle air passage and comprises two orifices in series, one orifice being disposed upstream of said other variable volume chamber and the other downstream of said other variable volume chamber, and a valve mechanism that is operable by a means that includes said armature means to regulate flow through said flow path that parallels said idle air passage, said other of said two orifices imposing a greater restriction on flow through said flow path that parallels said idle air passage than does said one orifice.

2. The improvement set forth in claim 1 wherein another portion of said flow path that parallels said idle air passage comprises a passageway extending through a body portion of said idle air control valve.

3. The improvement set forth in claim 2 wherein said passageway contains said one orifice.

4. The improvement set forth in claim 2 wherein said passageway contains said valve mechanism.

5. The improvement set forth in claim 2 wherein said passageway contains said one orifice and said valve mechanism.

6. In an internal combustion engine having a main induction air passage through which combustion air is inducted when the engine is operating at non-idle, an electronic control system that exercises control over certain functions associated with engine operation, and an idle air bypass valve assembly comprising an idle air passage bypassing that portion of the main induction air passage which contains a throttling mechanism for the main induction air passage, an idle air control valve for selectively controlling idle air flow through said idle air passage, a mechanism for operating said idle air control valve comprising an electrically powered transducer having an armature means that is selectively positionable along a path of travel in accordance with the value of a control signal issued by the electronic control system, the improvement in said mechanism comprising means causing said idle air control valve to allow flow through said idle air passage when said armature means is positioned to a position corresponding to the absence of electrical power to said transducer.

7. In an internal combustion engine having a main induction air passage through which combustion air is inducted when the engine is operating at non-idle, an electronic control system that exercises control over certain functions associated with engine operation, and an idle air bypass valve assembly comprising an idle air passage bypassing that portion of the main induction air passage which contains a throttling mechanism for the main induction air passage, an idle air control valve for selectively controlling idle air flow through said idle air passage, a mechanism comprising a transducer for operating said idle air control valve in accordance with the value of a control signal issued by said electronic control system, the improvement in said mechanism which comprises a movable wall that separates two variable volume chambers and is positioned by the respective volumes of said two chambers, the positioning of said movable wall serving to correspondingly position said idle air control valve for selectively controlling idle air flow through said idle air passage, one of said chambers forming a portion of said idle air passage and the other forming a portion of another passage that parallels said idle air passage, said another passage comprising orifice means arranged and sized to allow air to enter said other chamber at a rate that is different from the rate at which air can exit said other chamber, and valve means operable by said transducer for regulating flow through said another passage.

8. The improvement set forth in claim 7 wherein a body portion of said idle air control valve contains another portion of said another passage.

9. The improvement set forth in claim 8 wherein said orifice means comprises a pair of orifices, and one of said orifices is disposed in said another portion of said another passage.

10. The improvement set forth in claim 9 wherein said another portion of said another passage contains said valve means.

11. The improvement set forth in claim 8 wherein another portion of said another passage contains said valve means.

12. For use in an internal combustion engine having a main induction air passage through which combustion air is inducted when the engine is operating at non-idle, an idle air bypass valve assembly comprising an idle air passage for bypassing a portion of the engine main induction air passage which contains a mechanism for throttling the engine main induction air passage, an idle air control valve for selectively controlling idle air flow through said idle air passage, a mechanism for operating said idle air control valve comprising a transducer having an armature means that is selectively positionable along a path of travel in accordance with the value of a control signal received from an electronic control system that exercises control over certain functions associated with engine operation, said idle air bypass valve assembly comprising a movable wall that separates two variable volume chambers from each other and that is selectively positionable in accordance with the respective volumes of said variable volume chambers to select the degree of restriction imposed by said idle air control valve on flow through said idle air passage, one of said variable volume chambers forming a portion of said idle air passage and the other of said variable volume chambers forming a portion of a flow path that parallels said idle air passage and comprises two orifices in series, one orifice being disposed upstream of said other variable volume chamber and the other downstream of said other variable volume chamber, and a valve mechanism that is operable by a means that includes said armature means to regulate flow through said flow path that parallels said idle air passage, said other of said two orifices imposing a greater restriction on flow through said flow path that parallels said idle air passage than does said one orifice.

13. An assembly as set forth in claim 12 wherein another portion of said flow path that parallels said idle air passage comprises a passageway extending through a body portion of said idle air control valve.

14. An assembly as set forth in claim 13 wherein said passageway contains said one orifice.

15. An assembly as set forth in claim 13 wherein said passageway contains said valve mechanism.

16. An assembly as set forth in claim 13 wherein said passageway contains said one orifice and said valve mechanism.

17. For use in an internal combustion engine having a main induction air passage through which combustion air is inducted when the engine is operating at non-idle, an idle air bypass valve assembly comprising an idle air passage bypassing a portion of the engine main induction air passage containing a mechanism for throttling the engine main induction air passage, an idle air control valve for selectively controlling idle air flow through said idle air passage, a mechanism for operating said idle air control valve comprising an electrically powered transducer having an armature means that is selectively positionable along a path of travel in accordance with the value of a control signal issued by an electronic control system that exercises control over certain functions associated with engine operation, said mechanism comprising means causing said idle air control valve to allow flow through said idle air passage when said armature means is positioned to a position corresponding to the absence of electrical power to said transducer.

18. For use in an internal combustion engine having a main induction air passage through which combustion air is inducted when the engine is operating at non-idle, an idle air bypass valve assembly comprising an idle air passage bypassing a portion of the engine main induction air passage containing a mechanism for throttling the engine main induction air passage, an idle air control valve for selectively controlling idle air flow through said idle air passage, a mechanism comprising a transducer for operating said idle air control valve in accordance with the value of a control signal issued by an electronic control system that exercises control over certain functions associated with engine operation, said mechanism comprising a movable wall that separates two variable volume chambers and is positioned by the respective volumes of said two chambers, the positioning of said movable wall serving to correspondingly position said idle air control valve for selectively controlling idle air flow through said idle air passage, one of said chambers forming a portion of said idle air passage and the other forming a portion of another passage that parallels said idle air passage, said another passage comprising orifice means arranged and sized to allow air to enter said other chamber at a rate that is different from the rate at which air can exit said other chamber, and valve means operable by said transducer for regulating flow through said another passage.

19. The improvement set forth in claim 18 wherein a body portion of said idle air control valve contains another portion of said another passage.

20. The improvement set forth in claim 19 wherein said orifice means comprises a pair of orifices, and one of said orifices is disposed in said another portion of said another passage.

21. The improvement set forth in claim 20 wherein said another portion of said another passage contains said valve means.

22. The improvement set forth in claim 19 wherein another portion of said another passage contains said valve means.

23. A valve assembly that is useful as an idle air bypass control valve for an internal combustion engine and comprises a body, a main flow passage through said body extending between an inlet and an outlet, a valve seat disposed in said main flow passage, a control valve that is disposed in said main flow passage and is positionable with respect to said valve seat for exercising control over flow through said main flow passage between said inlet and said outlet, a movable wall that separates two variable volume chambers within said body and is operatively coupled to said control valve for positioning said control valve with respect to said seat in accordance with the respective volumes of said variable volume chambers, one of said variable volume chambers forming a portion of said main flow passage, and the other of said variable volume chambers forming a portion of another flow passage through said body that parallels at least a portion of said main flow passage, and control regulating means for controlledly regulating the positioning of said movable wall, and hence the positioning of said control valve relative to said valve seat, said control regulating means comprising means acting upon the flow through said another flow passage to cause the controlled regulation of the positioning f said movable wall.

24. A valve assembly as set forth in claim 23 in which said control regulating means comprises spring means that resiliently biases said movable wall away from said valve seat so as to thereby resiliently bias said control valve to a position allowing flow through said main flow passage, said another passage comprising orifice means arranged and sized to allow flow into said other variable volume chamber at a rate faster than that at which flow can exit said other variable volume chamber, and valve means for controlling flow through said another flow passage.

25. A valve assembly as set forth in claim 24 in which a portion of said another passage is formed by a passageway extending through said control valve, and said valve means is disposed in said passageway.

26. A valve assembly as set forth in claim 25 in which said valve means comprises a valve seat in said passageway, a valve element in said passageway, and a spring in said passageway that biases said valve element away from said last-mentioned valve seat so as to thereby resiliently bias said valve element to a position allowing flow through said passageway, and an actuating mechanism disposed in assocation with said body for positioning said valve element with respect to said last-mentioned valve seat, said actuating mechanism comprising an actuator that enters said passageway and engages said valve element.

27. A valve assembly as set forth in claim 26 in which said orifice means comprises a pair of orifices one of which is disposed in said passageway upstream of said last-mentioned valve seat and the other of which is disposed in said another flow passage downstream of said last-mentioned valve seat.

* * * * *